United States Patent [19]

Young

[11] Patent Number: 4,842,511

[45] Date of Patent: Jun. 27, 1989

[54] CARBON BAKING FURNACE—REFRACTORY CONSTRUCTION

[75] Inventor: Leland L. Young, Allison Park, Pa.

[73] Assignee: Aluminum Company of America, Pittsburgh, Pa.

[21] Appl. No.: 138,205

[22] Filed: Dec. 28, 1987

[51] Int. Cl.[4] ..... F27B 7/00

[52] U.S. Cl. ..... 432/192; 432/247

[58] Field of Search ..... 432/24, 209, 212, 213, 432/192, 247

[56] References Cited

U.S. PATENT DOCUMENTS 4,040,778 8/1977 Black ..... 432/192

4,687,439 8/1987 Olivarez, Jr. et al. ..... 432/192

4,744,749 5/1988 Dreyer et al. ..... 432/192 X

*Primary Examiner*—Edward G. Favors

*Attorney, Agent, or Firm*—Daniel A. Sullivan, Jr.

[57] ABSTRACT

A ring furnace having pits arranged in rows and sections with individual headwalls between adjacent pits in each row and flue sections separating adjacent pits in each section with the flue sections meeting end-to-end to provide a continuous flue on each side of a row of pits. The connection between adjacent flue section ends is adapted to provide for longitudinal expansion and contraction of each flue section, and is also adapted to provide a tight seal between connected flue ends without a need for using a sealing material at such connection.

16 Claims, 5 Drawing Sheets

CARBON BAKING FURNACE—REFRACTORY CONSTRUCTION

BACKGROUND OF THE INVENTION

This invention relates to a furnace for baking molded carbon shapes. More particularly, it relates to the refractory design and construction of ring-type furnaces for baking carbon anode and cathode blocks used in an electrolytic process for making a metal such as aluminum, for example.

Ring furnaces for baking carbon anode and cathode blocks used to produce aluminum are well known. A ring furnace is constructed in a manner which enables sequential preheating, baking, and cooling molded carbon blocks held in chambers commonly called pits on a continuous basis. The progression of these sequential operations is enabled by the induced flow of flue gases, fuel, and combustion/cooling air in a closed rectangular loop or ring of furnace flues adjacent the pits; hence, the name ring furnace.

The flues are formed by long parallel rows of spaced apart refractory end-to-end fluewalls, with the row ends joined together by a common flue passage called a crossover. A typical ring furnace has from 12 to 24 parallel rows of flues, and two such crossovers. Half of the parallel flue rows reside in the north (or east) side of a ring furnace and the other half reside in the south (or west) side of the furnace. Flue gas flow is in one direction through one side and in the opposite direction through the other side, the flow loop being closed by the common crossover flue at each end of the furnace. The inner flue row on each side of a furnace is typically spaced 2 to 10 feet away from the furnace centerline, depending on the furnace cranes and building design utilized.

The parallel rows of flues within each half furnace are spaced apart uniformly to form the sidewalls of open-top pits into which the carbon anode or cathode blocks are placed for baking. Pit width, depth and length are sized to efficiently accommodate the carbon blocks to be baked. Flue length and depth are conformed to pit length and depth. Flue widths typically have ranged from 15.75 to 20.25 inches. Pit and flue sizes typically are constant within a furnace, but differ from furnace to furnace. To form the end walls of individual pits and to interlock adjoining ends of fluewalls in each long row of flues, refractory headwalls are constructed laterally across each half furnace, at intervals determined by the desired pit length. In ring furnaces as built heretofore, the headwall width has typically been 18 inches between pits and 9 inches between the butting ends of flues where the fluewall ends fit into 4.5 inch deep vertical recesses (slots) on each side of the headwall. The lateral assembly of pits and fluewalls contained between successive headwalls in each half furnace is typically called a furnace section. Each section typically contains 5 to 11 pits and 6 to 12 flues. Each half furnace typically contains 16 to 48 sections (32 to 96 sections per furnace). The number of pits and flues per furnace section, and the number of sections per furnace, are a function of the output of baked blocks required from the furnace.

In operation of such a carbon baking furnace, all pits in a given section are at the same stage in the baking cycle at any given time. Sections are loaded and paced through the baking cycle in succession in a given direction, either clockwise or counterclockwise, around the furnace. At any given time, some sections of pits will be empty, some will be receiving their next loading of carbon blocks and packing coke, some will be heating, some soaking at final temperature, some cooling, some being unloaded, and some being repaired (reconditioned) prior to being reloaded for their next baking cycle. This operating cycle is imposed on each section of pits by a systematic repositioning of furnace firing equipment from section to section, at a specified frequency. The firing equipment consists of fabricated assemblies which rest on top of the furnace and typically are movable by overhead crane. The assemblies function to input fuel, input cooling and combustion air, exhaust spent flue gases, and control flue gas pressure and/or fluewall temperature. Each baking furnace typically has sufficient furnace sections for operation of multiple (usually 2 to 4) simultaneous baking cycles. Each baking cycle typically requires 16 to 26 tandem sections, the exact number being a function of the intended operating plan and expected pit productivity. Thus, a furnace for two simultaneous baking cycles, with 16 sections per cycle, would contain 32 furnace sections.

To complete each baking cycle, furnace refractories must be cycled through a wide temperature range. Fluewall temperature fluctuates from a low near room temperature to a high of 1250°–1350° C., and back to the low. Headwalls are cycled through only a slightly lower temperature range. The temperature changes induce commensurate expansion-contraction reversals which cause movement, and shifting, in both the fluewalls and headwalls. Space for the expansion must be provided at the ends of each fluewall and at intervals within, or at the ends of, each headwall. The major headwall expansion is lateral (at 90°) to the direction of major fluewall expansion. In the past, this relative movement, and other factors such as in-service shrinkage within the refractories, results with time in an ever-increasing looseness of fit of fluewall to headwall at each pit corner. Yet this fit, between each pit face of a fluewall and the adjacent side face of the headwall recess, must be kept "coke-tight" to prevent leakage of packing coke from the pits to the recess then into the flues. The coke is in loose powder form and is placed around and on top of the carbon blocks in each pit to prevent carbon oxidation (air-burning) and conduct heat to and from the blocks. Loss of coke into the flues can restrict the flue passage and reduce combustion efficiency within the flues and heat transfer between flues and pits. Entrained in flue gases, coke dust may create a fire hazard in the exhaust system and/or an emissions problem. Within the flues, it can burn out of control, causing localized overheating which distorts the fluewalls. Flues may also become bowed due to loss of expansion space in headwall recesses if the recesses are filled with coke.

It is essential, therefore, that the seal at the pit corners is maintained; and to do so has heretofore required the employment of expensive repair procedures. Because of the severity of the problems engendered by pit corner breakdown, it would be highly desirable to provide a furnace structure which maintains a tight seal at pit corners for relatively long periods of furnace operation.

SUMMARY OF THE INVENTION

In a ring furnace of this invention, the refractory construction at the intersections of the headwalls and flues is adapted to provide snug-fitting slip joints between butting flues at the ends of each section. Such joints allow the flues to expand and contract as a result of temperature cycling, while at the same time maintaining substantially tight seals at the joints without the need for joint filling materials. The refractory construction is further adapted for keying the ends of pit headwalls into spaced apart fluewalls which define the flues to provide lateral support for the fluewalls. Expansion joints in the headwalls are provided to care for expansion and contraction in the headwalls as a result of temperature cycling.

It is an objective of this invention to provide for expansion and contraction of flues and headwalls as a result of temperature cycling while maintaining a substantially tight seal at pit corners.

It is also an objective of this invention to reduce the refractory mass of a furnace by reducing the thickness of the headwalls from that which has been required heretofore.

It is an advantage of this invention that joint filler materials are not required to maintain a substantially tight joint seal at the pit corners.

These and other objectives and advantages will be more apparent with reference to the following description of a preferred embodiment and the accompanying drawings.

DESCRIPTION OF A PREFERRED EMBODIMENT

Figure 1:
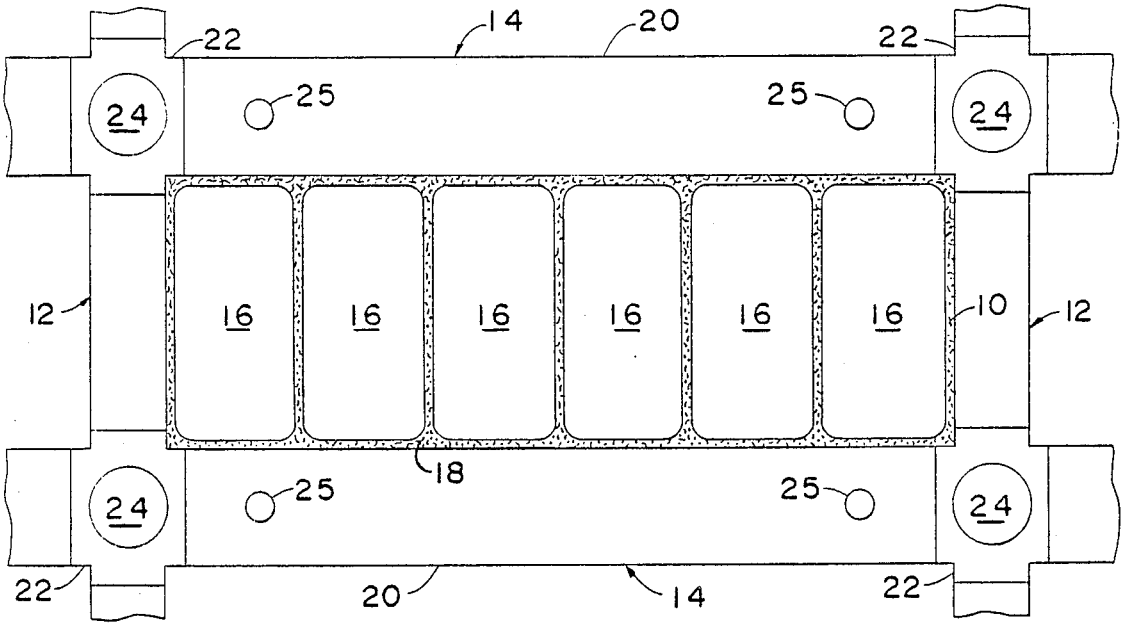
FIG. 1 PRIOR ART
FIG. 1 is a plan view of a portion of a prior art ring furnace.
Figure 2:
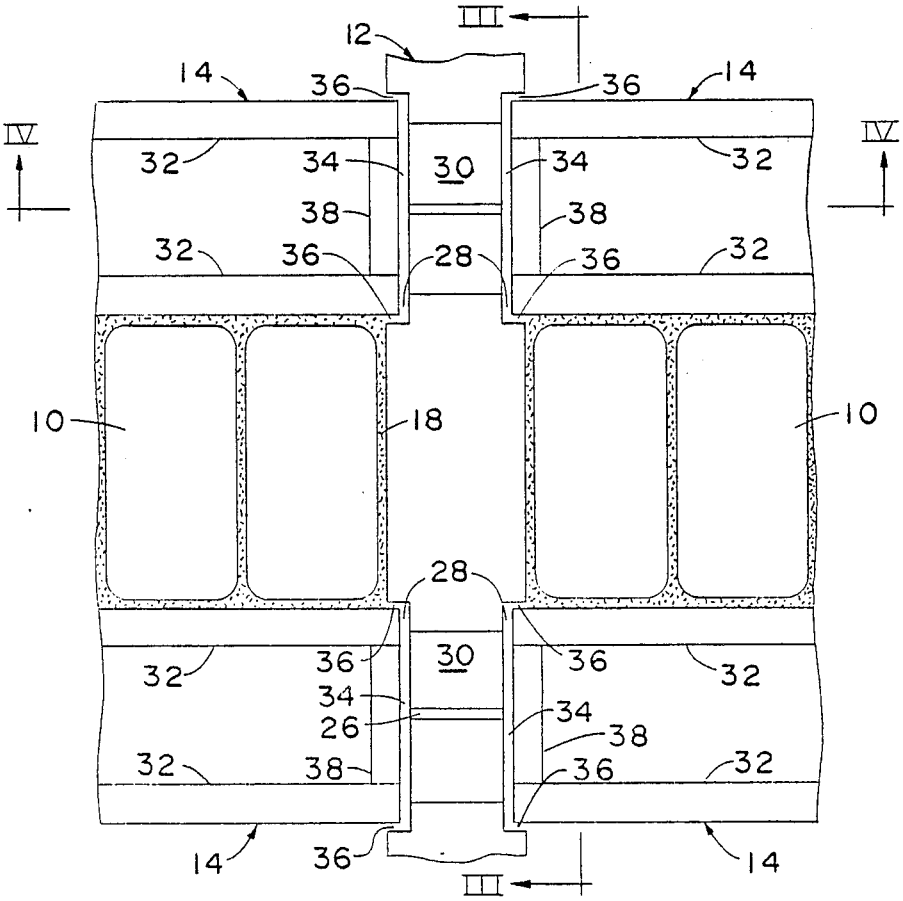
FIG. 2 PRIOR ART
FIG. 2 is a plan view of a fragmentary portion at a flue and headwall intersection of the furnace shown in FIG. 1 with flue caps and port blocks removed.
Figure 4:
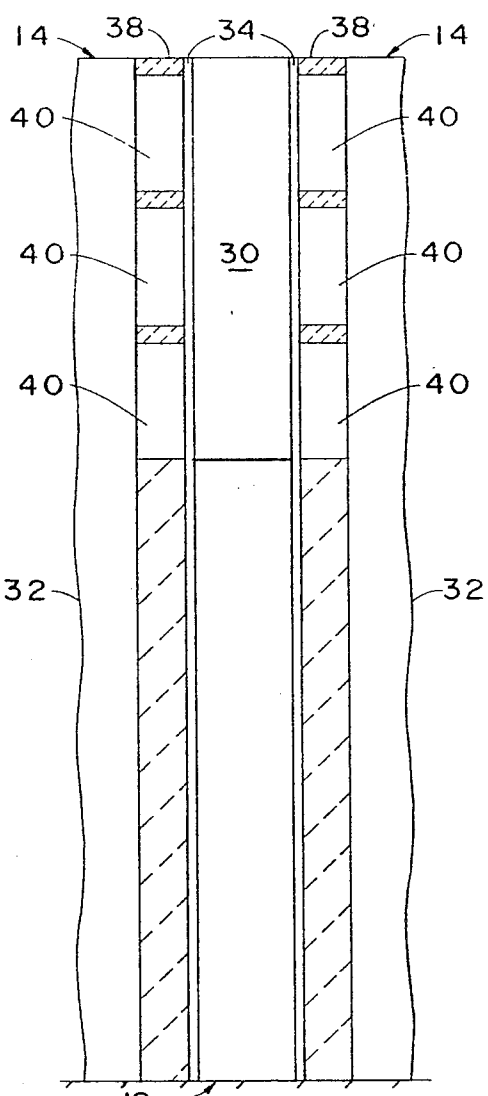
FIG. 4 PRIOR ART
FIG. 4 is a sectional view of the furnace portion shown in FIG. 2 through the headwall separating adjacent flues.
Figure 3:
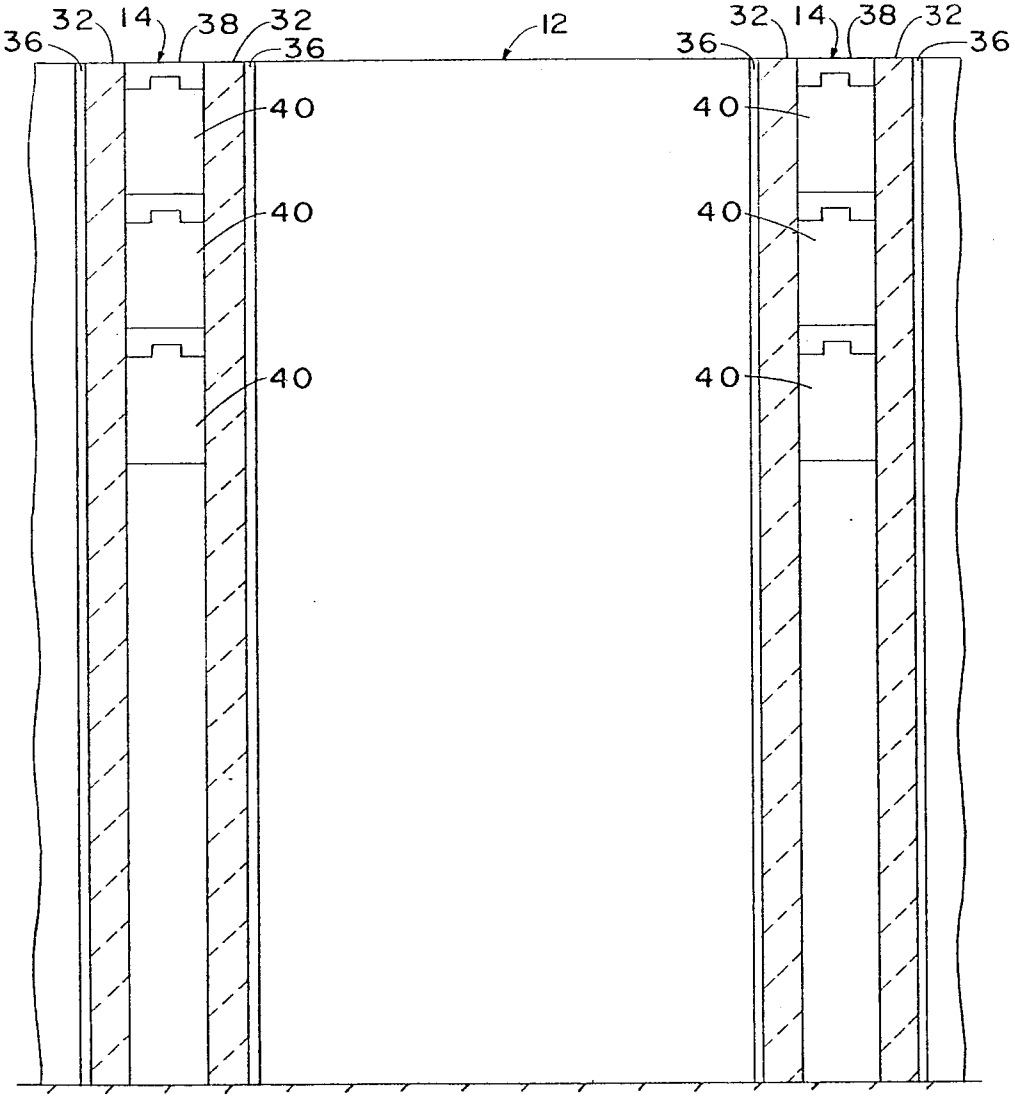
FIG. 3 PRIOR ART
FIG. 3 is a side view of a headwall of the furnace portion shown in FIG. 2 through a pit and sections through adjacent flues.

The pits of a ring furnace of this invention are arranged in rows and sections like those in a prior art ring furnace as described in the discussion of the Background of the Invention. The details of construction and structure at the intersection of a headwall and flue of a ring furnace of this invention, however, are substantially different from the construction and structure of a comparable intersection in a known ring furnace. To better understand these differences, an intersection of a flue and headwall of a typical ring furnace as previously constructed will be described with reference to FIGS. 1–4. Referring first to FIG. 1, each pit 10 in a ring furnace is defined by a headwall 12 on each end and a flue 14 along each side. Pits 10 vary substantially in size depending upon the size and number of anodes 16 to be fitted therein for baking. Whatever the number may be, the pit size is adapted so that the anodes 16 may be fit within the pit and provide space between adjacent anodes and between anodes and adjacent pit sidewalls. Carbon powder 18 is packed into the spaces between adjacent anodes 16 and between pit sidewalls and adjacent anodes. Alternatively, the pit size may be such that anodes are packed tight one against the other with space only between the anodes and furnace walls. The carbon powder 18 functions as a heat transfer means and also enables the anodes to expand and contract with temperature changes. Each flue 14 is covered with caps 20 and a port block 22 at intersections with headwalls 12 in order to make the flues substantially gas-tight except for central ports 24 through the port blocks 22. The central ports 24 are closed, however, when not being used to charge the flue with fuel, air, or to exhaust gases. Other small ports 25 through the flue caps 20 are typically provided for fuel input, temperature and pressure control and observation purposes. All of the foregoing elements of a ring furnace are made from refractory bricks or specially formed shapes. The types and shapes of refractory may vary depending upon the application and anticipated maximum temperature to which the brick or shape may be exposed. For a more detailed description of an intersection between a headwall and flue intersection in a typical prior ring furnace, reference is made to FIGS. 2–4. In each of the Figures, flue caps and port blocks are omitted to permit showing more clearly the details of the flue and headwall intersection. The headwall 12 is made up of refractory brick and is continuous across the entire length of a section of the furnace except for expansion joints 26 which are typically at or near the midpoint of each flue 14. A typical headwall 12 is 18 inches thick between pits 10, 10 with $4\frac{1}{2}$ inch opposing recesses 28, 28 at points of intersection with the flues 14, 14 which reduces the thickness of the headwall within the recesses to 9 inches. Expansion joints 26 at or near flue 14 centerlines are typically $\frac{1}{8}$ inch and filled with a combustible fiberboard which burns out leaving a space for headwall expansion. The headwall 12 is the full height of the pit 10 except for a portion of the wall at the flue intersection. To allow the introduction of flame or air, exhaust gas, or enable gas to flow down the flue 14 and through the headwall 12, a slotted opening 30 is provided in the portion within the flue extending downward from the top of the headwall. The depth of the slot 30 depends upon the depth of the pits 10, 10 and flue 14 design, and a typical depth is 2′8″.

Each flue 14 is comprised of two spaced apart fluewalls 32, 32 laid up with refractory brick. For the sake of clarity, joints between courses are not shown on the drawings, unless showing such a joint is necessary for descriptive purposes. In addition, refractory brick or shapes typically have matching tongue and groove features on opposing surfaces to effect an interlock, and such tongue and groove surfaces are not shown on the Figures in the interest of making the Figures clearer. A typical flue 14 is 1′6″ wide out-to-out and has a 0′9″ space between the walls 32, 32. Each flue 14 in a section terminates within a headwall recess 28 and a gap 34 between the flue end and headwall within the recess is provided to accommodate expansion and contraction of the flue from temperature cycling. The lateral fit of each flue in the recess must be snug to prevent coke 18 leakage into the recess. In an effort to prevent such leakage, a sealing space 36 has been provided between the side of each fluewall 32 and the recess 28 side surface in the construction of some prior furnaces. This sealing space 36 is packed with a sealing material which will not bond the fluewalls and headwall together so that the flue is free to expand and contract within the recess.

At each flue end, tie bricks 38 span the 0'9" space between the fluewalls 32, 32. The tie bricks 38 are laid in courses with staggered joints, typical of brick construction, until a level coincident with the bottom of the headwall slot 30 is reached. Thereafter, a plurality of openings 40 are provided through the tie bricks 38 which permit the passage of gases continuously down a flue 14.

From the foregoing description of the drawings, it may be seen that expansion and contraction of a flue 14 in a section is accommodated by the space 34 between the flue end and headwall at the base of the recess 28. For built-in-place fluewalls 32, 32, the gaps 36, 36 are approximately $\frac{1}{8}$ inch between each fluewall and side surface of the recess 28 to accommodate headwall 12 expansion. Subsequent in-service shifting and shrinkage of the headwall 12 typically results in enlargement of the gaps 36, 36, to as much as $\frac{3}{4}$ inch.

As an alternate method of construction, flues 14 may be prebuilt and lowered into the furnace within headwall recesses 28, 28. In this type of construction, the gaps 36, 36 are typically $\frac{3}{4}$ inch to $1\frac{1}{8}$ inch to provide needed installation clearance. The gaps are then filled with a refractory material, typically a ceramic fiber, in an effort to maintain pit corner integrity.

Whether built in-place or prebuilt, continuous use of the furnace tends to break down the joint seal material and cause it to fall out. Separation at the joint then allows loose packing coke 18 to pass through the joint into expansion space 34 and the flue 14. A furnace of this invention provides a solution to the problem of maintaining a seal at the intersection of the flue and headwall.

Figure 6:
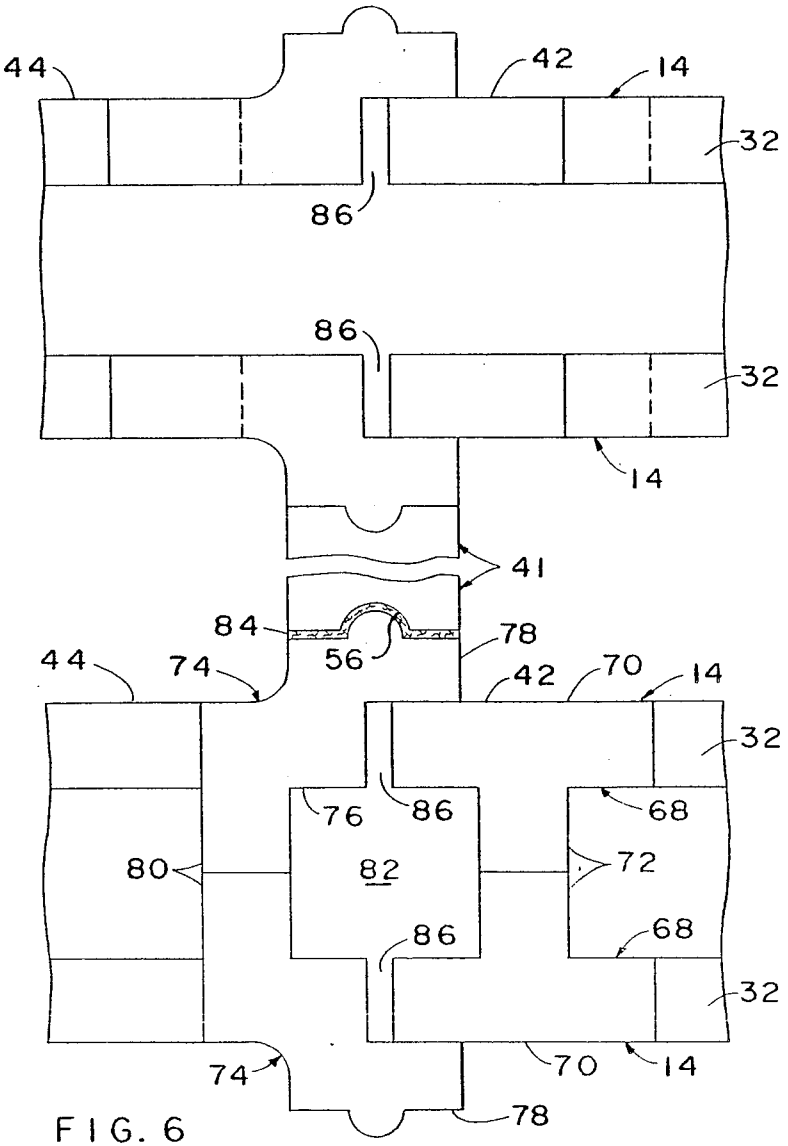
FIG. 6 is a plan view of an upper portion with the flue top wall removed of the ring furnace which lower portion is shown in FIG. 5.
Figure 5:
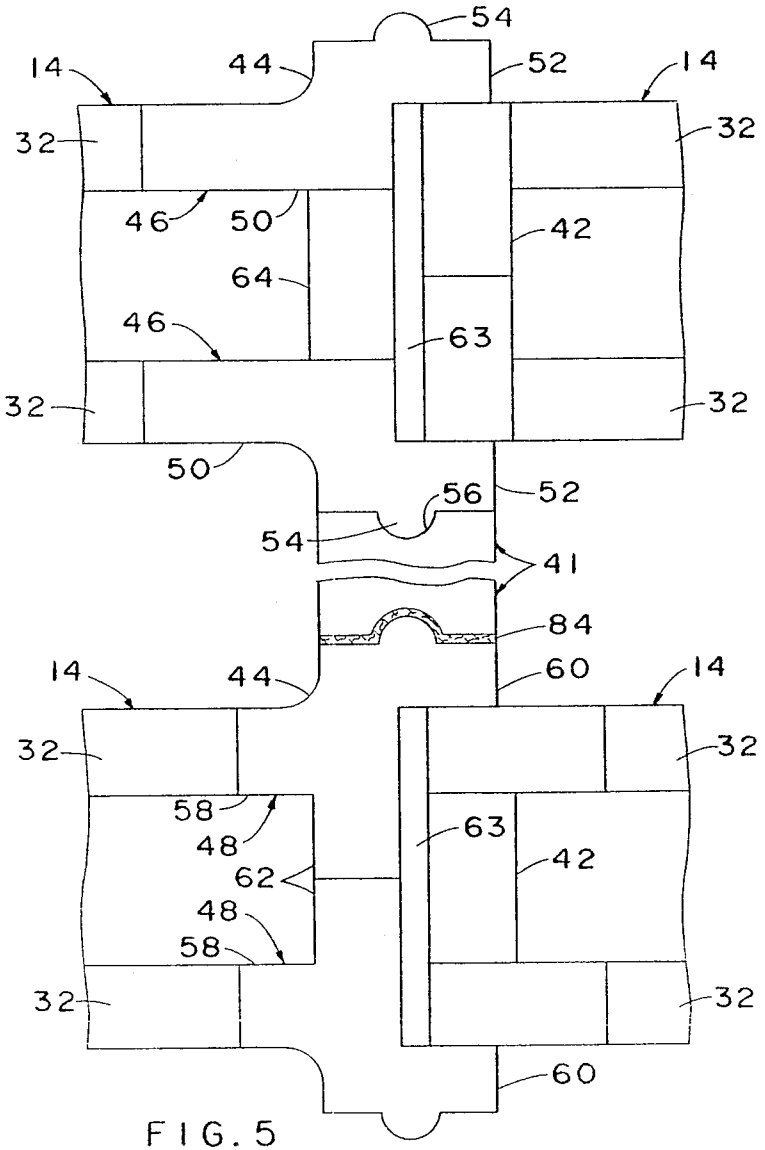
FIG. 5 is a sectional view of a lower portion of a ring furnace of this invention at the intersection of flues and headwalls.
Figure 7:
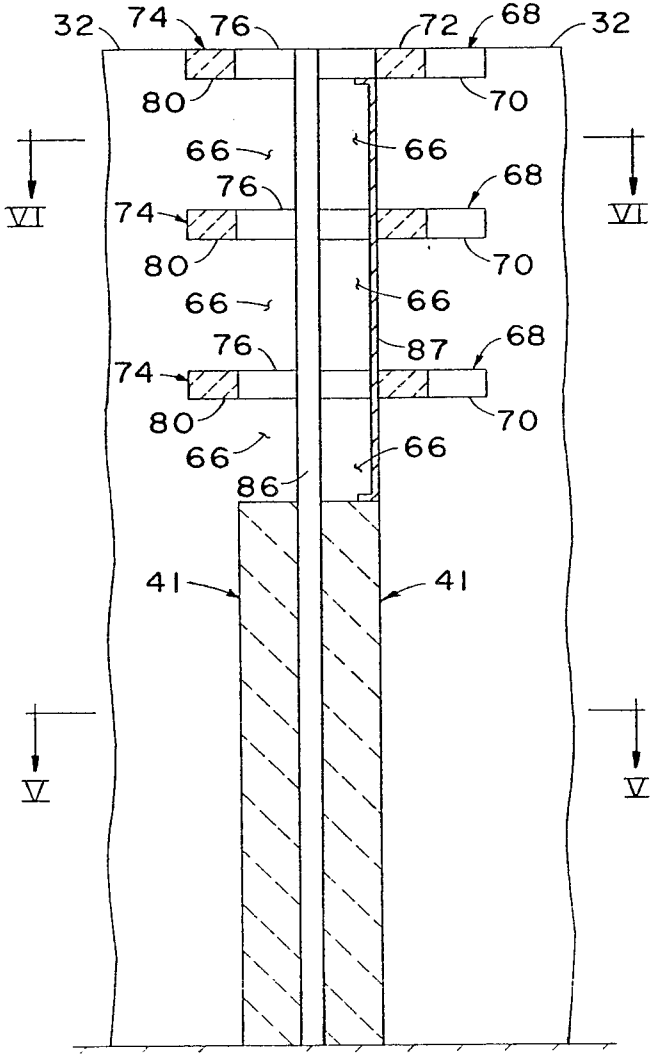
FIG. 7 is a sectional view through the headwall of the ring furnace portions shown in FIGS. 5 and 6.

Referring now to FIGS. 5–7, the structure and construction of a preferred embodiment of a ring furnace of this invention will be described. A sectional view of a fragmentary portion of a lower portion of a ring furnace of this invention is shown in FIG. 5. This is a plan view of the lower approximately 60% of flues 14, 14, 14, 14 where the flue ends are closed and a spacer headwall 41. A similar sectional plan view, FIG. 6, shows the upper approximately 40% of the flues 14 and spacer headwall 41, with the flue caps and ports removed and where the flue ends are substantially open. The details of construction at an intersection of the flue and headwall, will first be discussed with reference to FIG. 5. The adjoining flues 14, 14 in the bottom portion of the Figure and those in the top are shown in adjacent courses; that is, the Figure shows how the courses alternate as the fluewalls are laid up. The first feature to be noted is that adjoining flues 14, 14 are joined end-to-end directly, with male-female type expansion joints, to form a continuous line of flues 14, 14 not intersected as in past art by continuous headwalls. Headwalls 41 are discontinuous and serve only as pit end walls and spacers between adjacent flues.

The male end 42 of each flue 14 is constructed in the conventional manner using alternating courses of refractory brick tied into alternating courses of refractory brick in the fluewalls 32. The female end 44 is constructed with special refractory shapes to form a recess for the male end of the abutting flue. A first special shape 46 is laid up in alternating courses with a second special shape 48 at the ends of each of the fluewalls 32. The first special shape has a fluewall body portion 50 having a length equal to a typical brick used in laying up the wall. A headwall connecting portion 52 lies along a portion of the side of the body portion and extends outwardly from the end thereof. At the midpoint in the length of the headwall portion, an outwardly extending tongue 54 is provided to mate with a corresponding groove 56 in the end of the headwall 41. The second special shape 48 has a fluewall body portion 58 two-thirds the length of the body portion 50 in the first special shape 46. A headwall connection portion 60 identical to the headwall connection portion 52 in the first special shape 46 lies along a portion of the fluewall body portion 58 side surface. A flue end closure portion 62 projects outwardly from the fluewall body portion 58 adjacent the end thereof. It may be seen that in laying up courses at the ends of the fluewalls 32 using the first 46 and second 48 special shapes, a recess 63 is formed to accommodate the male end of the adjoining flue 14. A conventional brick 64 is laid between opposing first special shapes 46 to close off the flue end in those courses and bond the shapes 48 together. The lateral dimension of the recess is controlled to insure a snug (not tight) fit with the male flue end 42.

The upper portion (approximately 40%) of the flue 14, headwall 41 intersection will be described with reference to FIG. 6. As in FIG. 5, the upper and lower portions of the Figure show alternating courses in the fluewalls. In this portion, special shapes are also used to provide a male-female slip fit between adjoining flue ends. Referring first to the male end 42, three of each four courses at the ends of the fluewalls 32, 32, 32, 32 include refractory brick of suitable length to provide staggered joints in alternating courses as shown in solid and dashed lines. In these three courses, the flue end is not closed, thus providing openings 66 for passage of gases from flue to flue, as may be seen in FIG. 7. In each fourth course, a special T shape 68 is used to provide lateral support for opposing fluewalls 32, 32. The T shape 68 has a fluewall body portion 70 having a length identical with the longest of the bricks used in the three open end courses. A fluewall support portion 72 projects outwardly at the midpoint of the length of the fluewall portion 70. The support portion 72 is of sufficient length that ends of such portions on opposing T shapes are in an abutting relationship, as shown in FIG. 6.

The female end 44 of each flue 14 includes alternating courses of special shapes to provide a recess to accommodate the male end 42. In three of each four courses corresponding to the three courses providing an open end in the male end 42, first special shapes 46 are alternated with a fourth special shape which is identical with the second special shape 48 except it does not include the flue end closure portion 62. The fluewall end of the fourth special shape is shown as a dashed line in FIG. 6. In each fourth course corresponding to each fourth course in the male end 42, a fifth special shape 74 is used. The fifth special shape 74 includes a fluewall body portion 76, a headwall connection portion 78 identical to the headwall connection portions on the other special shapes, and a fluewall support portion 80 projecting from the side of the body portion 76 adjacent the fluewall joint end thereof. It is to be noted that all of the special shapes in this embodiment, as well as other embodiments to be described later, are preferably provided with tongues and grooves on matching faces to facilitate erection and strength of assembly.

Thus constructed, openings 66 are provided through the flue ends to allow continuous passage of gases through a line of flues. In addition, an exhaust port 82 is provided for exhausting flue gases. An exhaust port block (not shown) covers the port 82 at the top of the flue. A central opening through the block accommodates an inlet to a manifold for exhausting spent gases, or is opened to permit entry of air for cooling and combustion. The central opening is plugged to cap the port 82 when such port is not being used as an exhaust or input point. Access through the central opening is also required for insertion of a flue end seal 87 (FIG. 7) to stop the flow of gases at selected points during operation of the furnace. The headwall 41 may be made of refractory brick or specially cast shapes, depending on cost and practicality of using shapes of special length and/or thickness. An expansion joint 84, typically $\frac{1}{8}$ to $\frac{1}{4}$ inch, may be provided at the midpoint of the wall 41 or, preferably as shown in FIG. 6, at its grooved end 56. The expansion joint is filled with a suitable temperature resistant packing such as a ceramic fiber, for example, to keep it free of packing coke initially, but coke penetration into or through the joint will have no serious effect.

A feature and advantage of a ring furnace of this invention is that the headwall 41 has no function in keeping flues free of packing coke. The headwall functions only to separate pits 10 and maintain lateral flue 14 spacing. By leaving a space 86 between opposing ends of the flues 14, 14, the male end 42 is free to move within the female end 44 of the next adjacent flue, unaffected by the headwall 41. The expansion space 86 between the flue ends can be conveniently established by filling the space with corrugated fiberboard when the flues 14, 14 are installed. The fiberboard burns out when the flues are fired. The principal feature of this flue construction is that it produces close fitting flue end seal joints that will remain close fitting through long periods of use. Mating ends of flues will expand and contract together laterally, retaining the close fit which is not altered by headwall expansion and contraction. The fit between the faying surfaces of the male end 42 and female end 44 can be made tight enough to seal out pit packing coke, yet loose enough to allow free relative movement of the flue ends.

Figure 8:
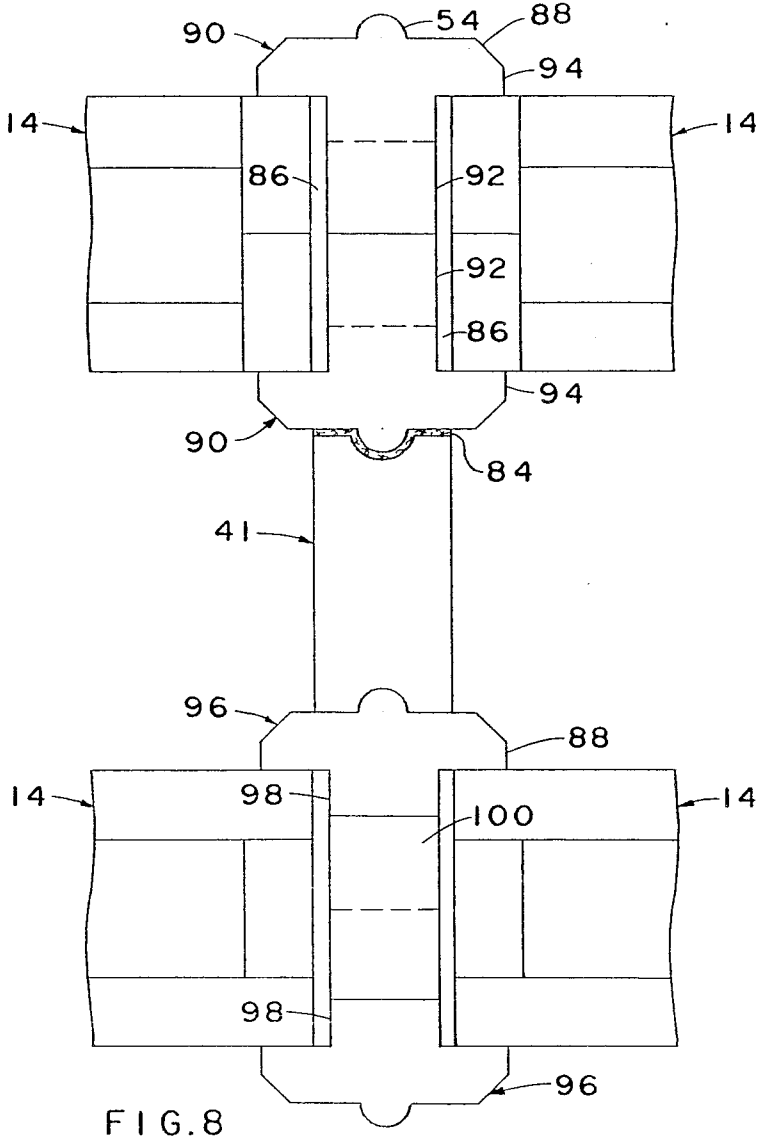
FIG. 8 is a sectional view of a lower portion of an alternate embodiment of a ring furnace of this invention at the intersection of flues and headwalls.
Figure 9:
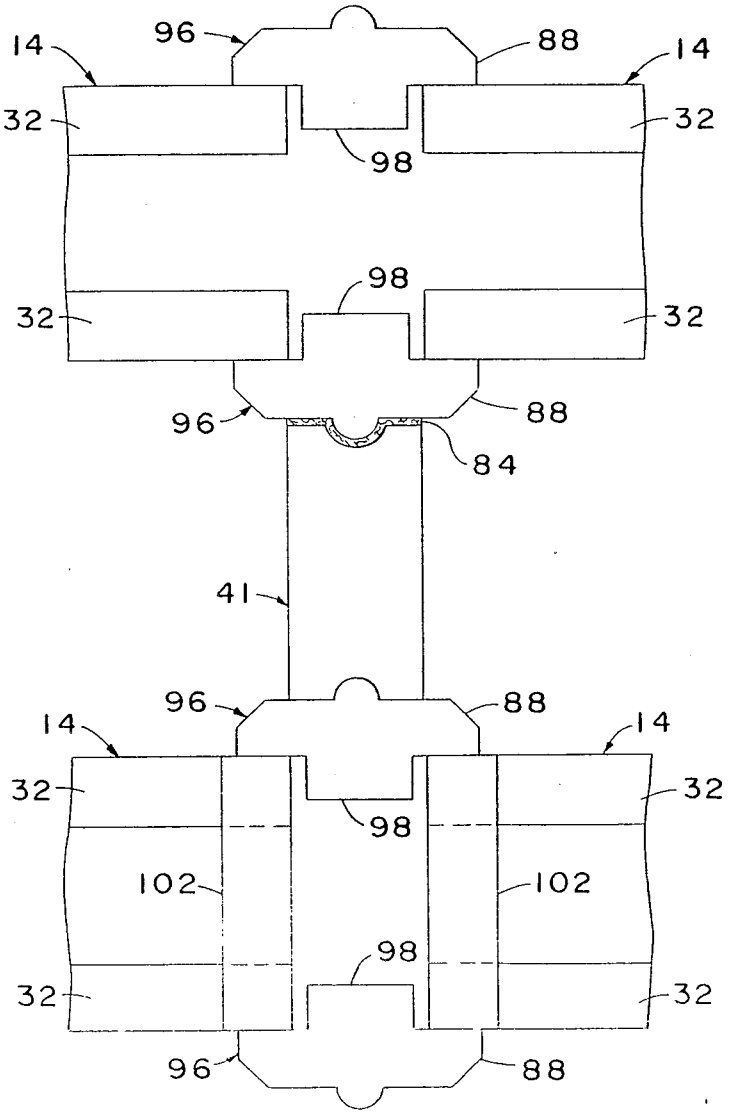
FIG. 9 is a plan view of an upper portion of the furnace whose lower portion is shown in FIG. 8 with the flue cap and port block removed.

An alternate embodiment of this invention is shown in FIGS. 8 and 9. It uses conventional fluewalls with no special shapes such as are required for the first embodiment. Special refractory T shapes are used, however, to form an H-shaped flue connector. Each H-shaped connector stands between flue ends and functions to provide a male-female flue end connection like that of the first embodiment.

Referring first to FIG. 8 which shows a headwall/flue intersection in the lower part of the furnace, the flues 14, 14, 14, 14 are built using conventional refractory brick in a manner known to those skilled in the art. In this lower part of the furnace, the flue ends are closed. Between adjoining flues, a flue connector 88 is constructed using special T-shaped refractories laid up in alternating courses. The flues 14, 14 and flue connector shown in the upper part of FIG. 8 show one course, and the lower part of the Figure shows an alternating course. A sixth special shape 90 has a stem 92 between the flue ends and a cap 94 extending away from each side of the stem. The stem 92 is sized to butt against the stem of the opposing sixth special shape 90 while providing a tight fit between the cap 94 and the flue end. Spaces 86, 86 between the stems 92, 92 and flue ends is provided to allow for expansion of the flues. Combustible spacers, such as corrugated fiberboard, are used during construction of the furnace to control the space dimension. The cap 94 has an outwardly projecting tongue 54 like that on previously described special shapes to fit within a matching groove in the headwall 41.

A seventh special shape 96 is provided for alternating courses as shown in the bottom portion of FIG. 8. This seventh special shape 96 is identical to the sixth special shape except that the stem 98 is shortened and a block 100 is laid between opposing stems 98, 98 to provide a fully bonded structure; that is, with staggered joints as shown with solid and dashed lines. As in the first embodiment, the headwall 41 can be made of refractory brick or specially cast blocks, and an expansion joint 84 can be provided at one of the headwall/connector joints or at the midpoint of the headwall.

In the upper portion of the furnace shown in FIG. 9, the flues 14 have substantially open ends. In every fourth course, a tie brick 102 is used to join opposite fluewalls 32, 32 to provide lateral support. The upper portion of the flue connector 88 is constructed with seventh special shapes 96 laid one on another in each course. The shortened stems 98 provide an opening through the connector from flue to flue and down from the top for charging air or gas or exhausting gases when required.

Thus constructed, this embodiment, like the first embodiment, provides a male-female connection at the flue ends to permit longitudinal expansion of the flues. Since the H-shaped connectors and headwalls are independent of each other and an expansion joint is provided between the headwall and connector, each can expand or contract independent of the other. Thus, the connector 88 expands and contracts laterally with, not against, the flues 14, 14 and the integrity of the joint is maintained without any need for a sealing material at the joint.

The foregoing two embodiments of this invention apply for a ring furnace in which replacement flues are constructed in place. But some carbon baking furnaces are designed and equipped for faster replacement, utilizing flues assembled outside the furnace and set into the furnace by overhead crane. A typical prebuilt flue is 13 to 15 ft. long ×11 to 13 ft. high ×1'6" to 1'8" wide, complete with inner baffles. As is well known to those skilled in the art, lowering such a large assembly into position requires relatively large clearances, and neither the preferred embodiment nor the alternate embodiment as just described could be assembled by lowering prebuilt flues into place because of the relatively tight lateral fit of the male-female connections.

Figure 10:
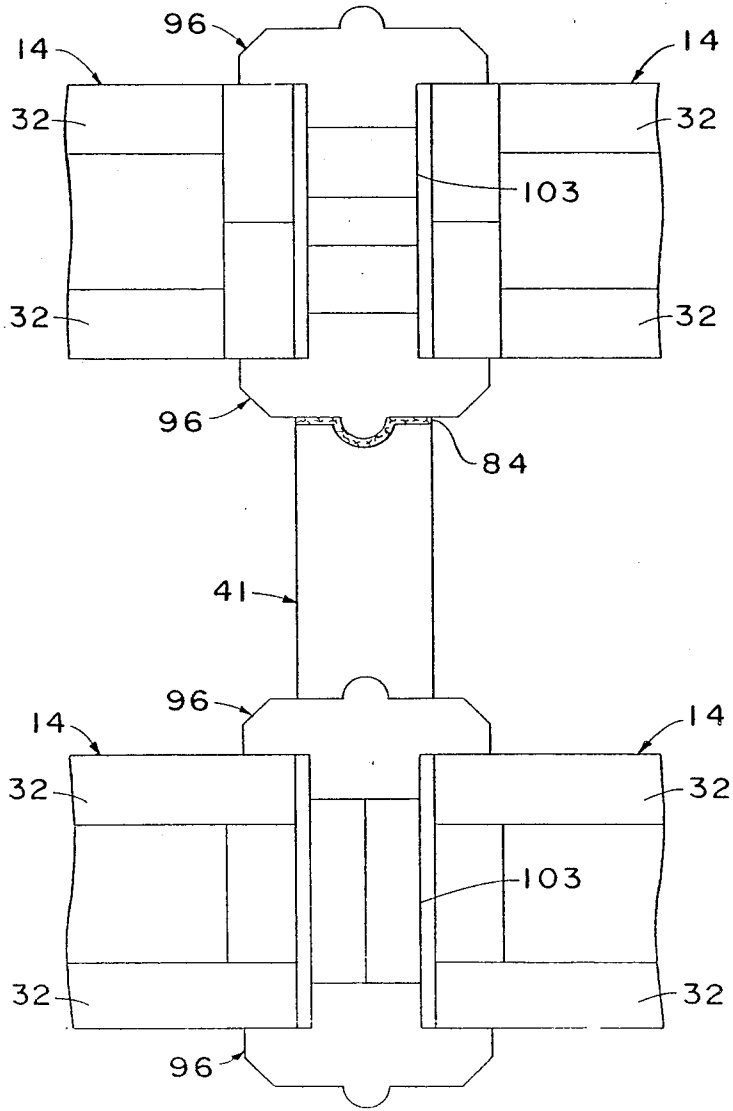
FIG. 10 is a sectional view at the intersection of fluewalls and headwalls of a lower portion of a ring furnace of this invention which incorporates prebuilt flues.

A third embodiment of this invention provides an alternate arrangement for furnaces utilizing prebuilt fluewalls. This arrangement provides the desired refractory-to-refractory pit corner joints that can be kept tight to prevent leakage of packing coke, yet will not restrict fluewall expansion and contraction. Its construction is similar to that of the above second embodiment, but the H-shaped structure in the lower portion between flue ends is modified as shown in FIG. 10 to use the short stem seventh special shapes 96 with spacer bricks 103 between them in each course, with no overlapping bond between the special shapes. Note, however, that the spacer brick structure between the special shapes is fully bonded as indicated by the showing of alternating courses in the upper and lower portions of FIG. 10. This arrangement is intended to expedite removal, and later replacement, of the T shapes on one side (or both sides) of each fluewall to be replaced, to provide the clearance required to lower a prebuilt replacement fluewall into position. Removal of the T-shapes necessitates, of course, prior removal of the spacer headwall, between adjoining flue lines, that keys to the T shapes to be removed. The upper portion of flue ends of this third embodiment is identical to that described and shown in FIG. 9.

Each of the embodiments of a ring furnace of this invention as just described varies in detail, but each has certain features in common. Each features a close mortarless fit between faying surfaces of directly joined flues or of flues and their intervening connectors. The refractory structures forming the close fit will expand and contract together, keeping the close fit intact through long periods of operation. Joint filling and sealing materials are unnecessary initially or later. The independent headwalls 41 separating pits 10 are no longer a significant element in the prevention of packing coke leakage into flues. And these advantages are attainable in ring furnaces utilizing prebuilt fluewalls, assuming the trade-off cost and time required for dismantling and reinstallation of spacer headwalls and fluewall connector T shapes is acceptable. Another desirable feature of each embodiment is a reduction of the mass of the headwalls which in this invention need be only thick enough to withstand the structural loads imposed upon them as separators between pits. This permits use of 0'9" to 1'0" thick headwalls, rather than the 1'6" thick headwalls heretofore required.

While the invention has been described in terms of preferred embodiments, the claims appended hereto are intended to encompass all embodiments which fall within the spirit of the invention.

What is claimed is:

1. A ring furnace, comprising:

a plurality of pits in rows and sections with flues separating adjacent pits in sections with the flues joined end-to-end with slip joints to provide a continuous flue on each side of each row of pits, the slip joints accommodating expansion of the flues while blocking incursion of carbon powder or packing coke into the flues without need for packing with a non-bonding sealing material, and with individual headwalls separating adjacent pits in each row with opposing ends of each headwall connected to flues on each side of the pits.

2. A furnace as claimed in claim 1 which further includes means for connecting the opposing ends of the headwall to the flues with an interlocking connection.

3. A furnace as claimed in claim 2 wherein the connecting means is a tongue-and-groove connection.

4. A furnace as claimed in claim 3 wherein an expansion joint is provided at the tongue-and-groove connection.

5. A furnace as claimed in claim 1 wherein the flue end-to-end connection is a male-female slip joint.

6. A furnace as claimed in claim 5 wherein an end of one flue section is the male portion of the connection and an end of the next adjacent section is the female portion.

7. A furnace as claimed in claim 5 wherein a connector between a flue section and a next adjoining flue section has a recess on each side thereof and ends of the flue sections are within each recess in a relatively tight lateral fit.

8. A furnace as claimed in claim 7 wherein the recesses are defined by a central portion of the connector between the flue ends and flanges at each end of the central portion projecting outwardly from the sides thereof.

9. A furnace as claimed in claim 8 wherein the central portion and flanges are made of fully bonded refractory shapes.

10. A furnace as claimed in claim 8 wherein the central portion is made of fully bonded shapes and the flanges butt against the ends of the central portion without any bonding therebetween.

11. A ring furnace having flue sections made from refractories connected end-for-end with a male end of one flue section slip fit into a female end of the next adjoining flue section in a refractory-to-refractory slip fit.

12. A ring furnace comprising:

a plurality of pits arranged in rows separated by individual headwalls which define ends of the pits;

rows of flues defined by spaced apart fluewalls, which walls define the sides of the pits;

connection means at ends of adjoining sections in each row of flues to provide a continuous flue in each row passing between adjacent headwalls and with the connection means adapted to provide for longitudinal expansion and contraction of each flue section while blocking incursion of carbon powder or packing coke into the flues; and means for connecting opposing ends of each headwall to a flue at each of the ends so that the headwall can expand and contract between the flues.

13. A ring furnace as claimed in claim 12 wherein the connection means at ends of adjoining flue sections is a slip fit connection between a female end of one of the sections and a male end of the other section.

14. A ring furnace as claimed in claim 12 wherein the connection means at ends of adjoining flue sections is a slip fit connection between ends of adjoining flue sections and recesses in an H-shaped connector separating the ends of the adjoining flue sections.

15. A ring furnace as claimed in claim 12 wherein the means for connecting a headwall end with a flue is a tonge and groove connection having a suitable temperature resistant packing therein.

16. A furnace as claimed in claim 1 containing headwall expansion joint means (84) located such that any leakage of carbon powder or packing coke is from pit to pit, rather than from pit to flue.

* * * * *